US006058737A

United States Patent [19]

Domagala

[11] Patent Number: 6,058,737

[45] Date of Patent: May 9, 2000

[54] CONVERTIBLE WIRE EARRING

[76] Inventor: Arlene S. Domagala, 1410 N. Mitchell Ave., Arlington Heights, Ill. 60004

[21] Appl. No.: 09/057,683

[22] Filed: Apr. 9, 1998

[51] Int. Cl.[7] ..... A44C 7/00

[52] U.S. Cl. ..... 63/12; 63/13; 63/29.1; D11/43

[58] Field of Search ..... 63/12, 13, 14.1, 63/14.4, 14.5, 29.1; D11/43

[56] References Cited

U.S. PATENT DOCUMENTS

| | | | |
|---|---|---|---|
| 58,501 | 10/1866 | Stefani | 63/29.1 |
| 242,528 | 6/1881 | Granbery | 63/13 |
| 483,214 | 9/1892 | Gaynor | 63/13 |
| 711,269 | 10/1902 | Wolfberg | 63/12 |
| 4,907,424 | 3/1990 | Reinstein et al. | 63/13 X |
| 5,080,518 | 1/1992 | Mason | 63/12 |

FOREIGN PATENT DOCUMENTS

| | | | |
|---|---|---|---|
| 1207104 | 2/1960 | France | 63/29.1 |
| 102184 | 3/1899 | Germany | 63/13 |

*Primary Examiner*—Terry Lee Melius
*Assistant Examiner*—Andrea Chop
*Attorney, Agent, or Firm*—Lawrence Cruz

[57] ABSTRACT

A convertible, closeable-loop earring enables an additional gemstone or component to be selectively attached or removed. The earring includes a permanent setting with a stem-receiving gap to receive a stem attached to the selectively removable and attachable gemstone or component in order to prevent relative rotation with the earring wire.

6 Claims, 5 Drawing Sheets

CONVERTIBLE WIRE EARRING

BACKGROUND OF THE INVENTION

The present invention is directed to jewelry and, more specifically, to earrings comprising a wire forming a closeable loop and being adapted to selectively add or remove an additional component or assembly. The present invention is further directed to stabilizing means for securing one or more additional components to an earring and preventing it from moving relative thereto. In addition, the present invention is directed to a method of making such earrings and additional components.

Convertible earrings of different types exist which provide, generally, a hook or threaded-type connection to attach a pendant or gem to the earring. Convertible earrings are useful primarily because they provide versatility for wearers who may own only a few pairs of earrings or who want to coordinate earrings with a wide variety of accessories and clothing. Certain individuals, for example, may require only non-allergenic posts or hoops and must therefore purchase high quality gold or other expensive earrings. The expense of these types of earrings limit the quantity that one person can own. Other individuals may desire to, on occasion, supplement gem-less earrings, or earrings with neutral color gemstones, with specific gem types or colors. Still, others may not find it suitable to wear, for example, diamonds to certain occasions, yet they may want to wear a particular set of earrings. By providing the ability to convert the earrings by adding or removing diamonds, the set of earrings are versatile enough to suit a wide variety of occasions. Convertible earrings provide the versatility for wearers to use the same pair of earrings in such a way as to have a virtually limitless variety of looks.

The "Eurowire" style earring is a preferred style of earring that is in the form of a closeable wire loop that, when closed, generally forms either an oval or a rounded "D" shape. The Eurowire typically has one gem fixedly mounted near the bottom of the front side. A closing latch or a spring-fit hook are provided on the opposite, or back, side.

The currently known convertible earrings comprise post-type earrings that receive an additional component in a free-hanging or rotatable manner. None are provided in the Eurowire style. Of those known convertible earrings, none have addressed the problem of stabilizing a gem against rotation about a wire upon which it is mounted.

SUMMARY OF THE INVENTION

The present invention is directed to a convertible, closeable loop earring, such as a Eurowire style earring, that enables an additional gem stone or component to be selectively attached or removed. When attached, the gemstone is fixed against rotation relative to the wire. In one embodiment, the gemstone is fixed against longitudinal movement along the wire.

The invention generally comprises a supplemental setting for a gemstone that has a downwardly extending stem that is generally parallel to a hole extending through the setting for receiving a wire. The stem is designed to fit into a gap between an originally mounted gemstone and the wire of the earring, when the supplemental gemstone is threaded over the wire and positioned above the original gemstone. The stem can be configured as a flexible wedge or other suitable means to provide a resilient press-fit or friction-fit into the gap between the original setting and the wire.

DESCRIPTION OF THE PREFERRED EMBODIMENTS

Figure 1:
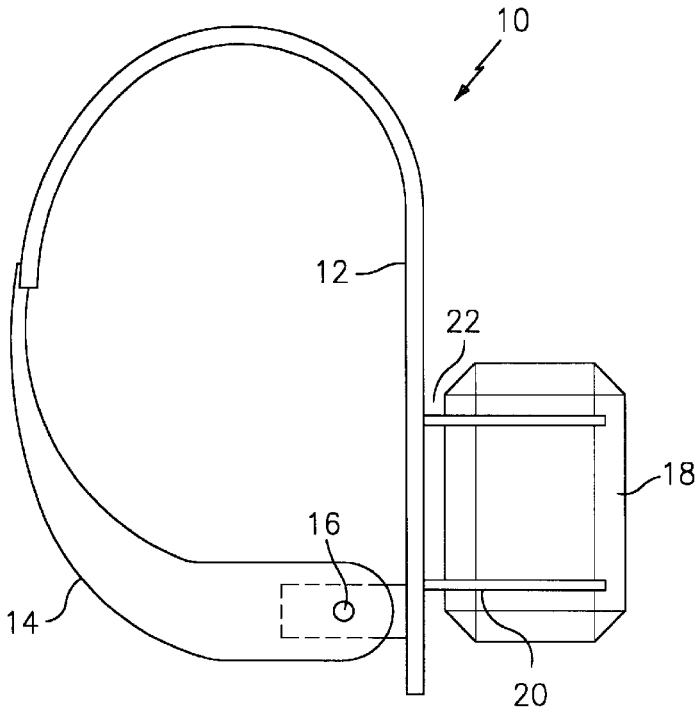
FIG. 1 (PRIOR ART)
FIG. 1 is a side view of a first conventional Eurowire style earring in a closed position.
Figure 2:
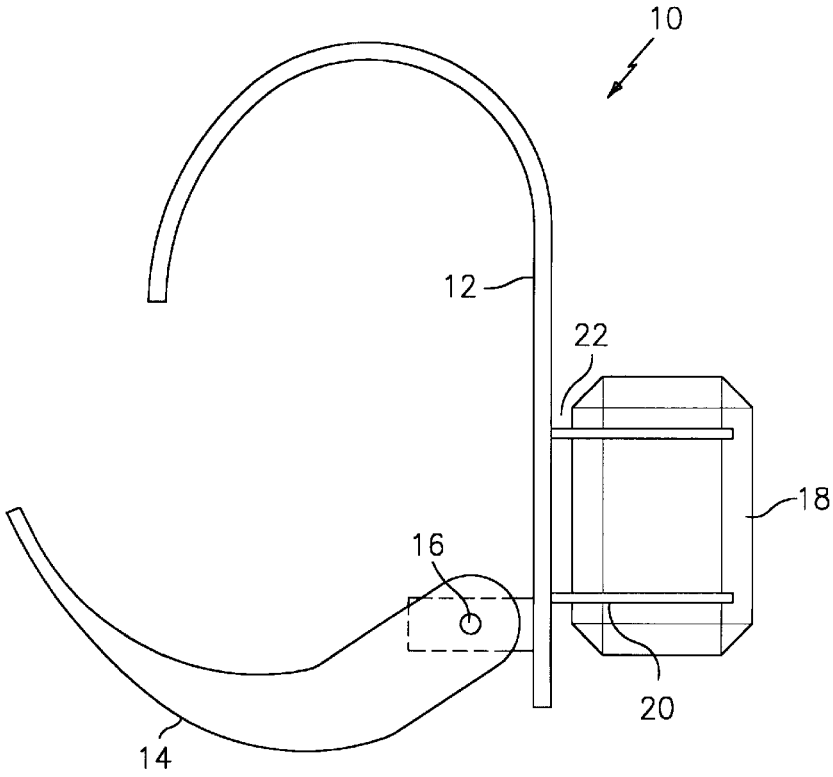
FIG. 2 (PRIOR ART)
FIG. 2 is a side view of the earring of FIG. 1, shown in an opened position.

Shown in FIGS. 1 and 2 is conventional Eurowire style earring (10) in the closed and opened positions, respectively. The earring (10) comprises a wire (12) having a clasp (14) that pivots about a hinge (16) in order to move between a closed position as shown in FIG. 1 and an opened position as shown in FIG. 2. The Eurowire earring (10) typically has a gemstone (18) held to the wire by a setting (20). Ordinarily there is a gap (22) between the wire (12) and the setting (20). In use, the wearer threads the wire (12) through the pierced hole (not shown) in the earlobe (not shown) so that the gemstone (18) is positioned at the bottom and in the front when the earring (10) is hanging.

Figure 3:
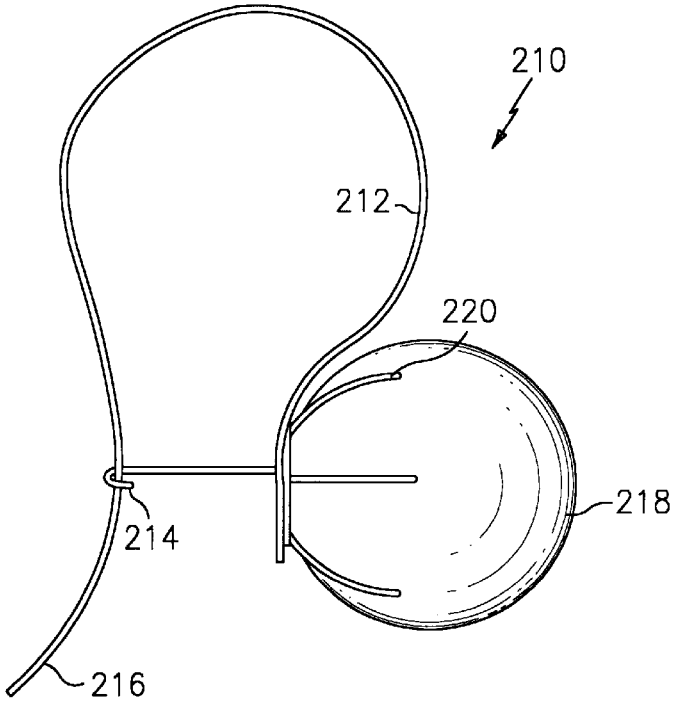
FIG. 3 (PRIOR ART)
FIG. 3 is side view of a second conventional Eurowire style earring in a closed position.
Figure 4:
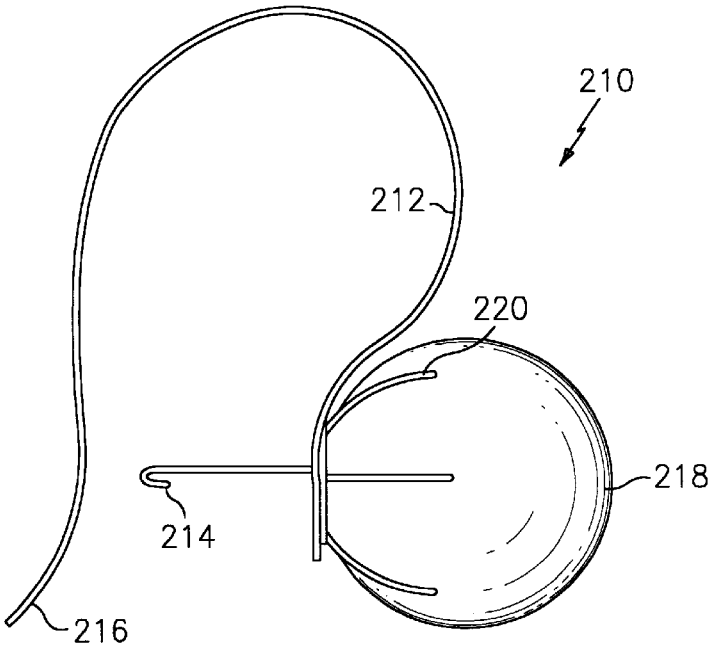
FIG. 4 (PRIOR ART)
FIG. 4 is a side view of the earring of FIG. 3, shown in an opened position.

Another conventional style of Eurowire earring (210) is shown in FIGS. 3 and 4. The earring (210) comprises a wire (212) having a hook end (214) that grasps the other end (216), in spring tension, in order to move between a closed position as shown in FIG. 3 and an opened position as shown in FIG. 4. A gemstone (218) is held to the wire by a setting (220).

For purposes of this disclosure, the present invention will be discussed with reference to the Eurowire earring style shown in FIGS. 1 and 2 only, though it is realized that the present invention applies to any Eurowire style or similarly structured earring.

Figure 6:
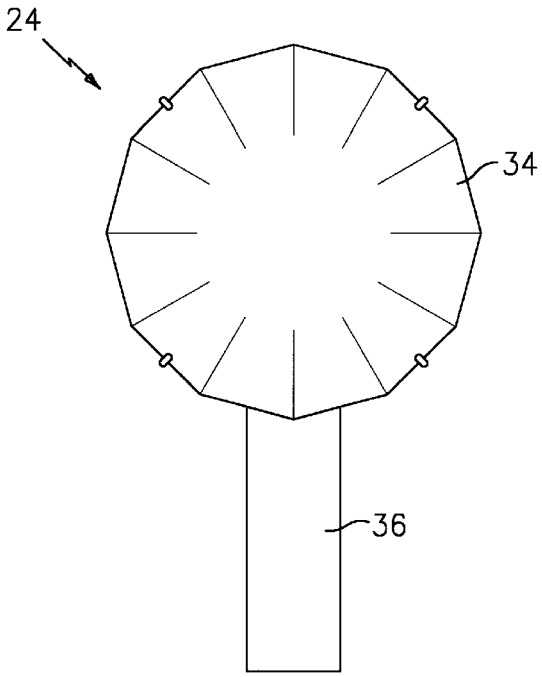
FIG. 6 is a front view of the present invention supplemental ornamental assembly of FIG. 5.
Figure 5:
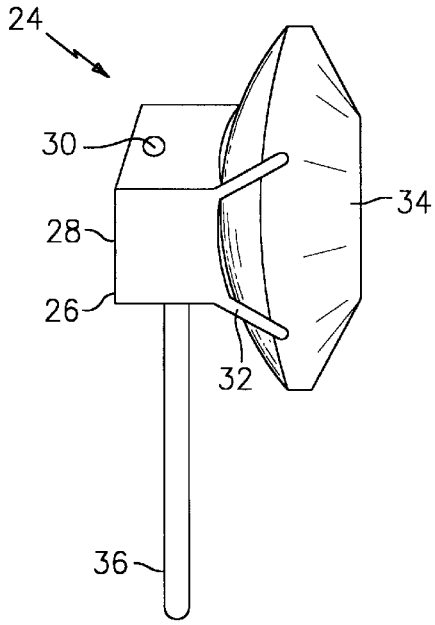
FIG. 5 is a perspective view of a first embodiment of the present invention supplemental ornamental assembly.
Figure 11:
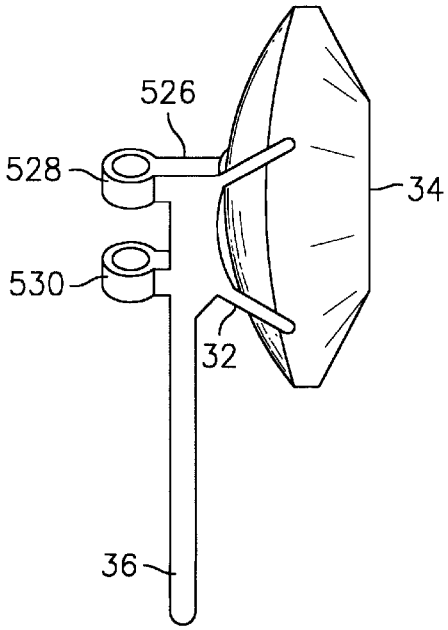
FIG. 11 is a perspective view of a fourth embodiment of the present invention supplemental ornamental assembly.
Figure 12:
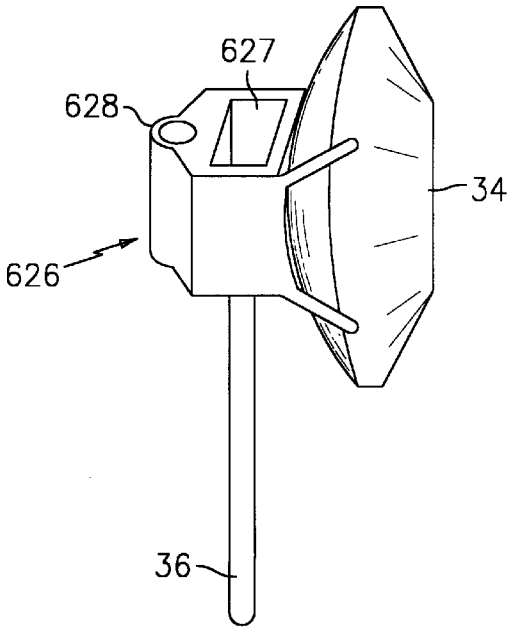
FIG. 12 is a perspective view of a fifth embodiment of the present invention supplemental ornamental assembly.

A supplemental jewelry assembly (24) is shown in FIGS. 5 and 6. The assembly (24) comprises a body (26) preferably in the form of a block (28) having a hole (30) therethrough, or in another form having a hole or loop such as shown in FIGS. 11 and 12 and discussed below, and supporting a setting (32) or other desirable ornamental structure (not shown). In the preferred embodiment, the setting (32) is shown holding a gemstone (34), such as a diamond. A stem (36) extends downwardly from the body (26).

Figure 8:
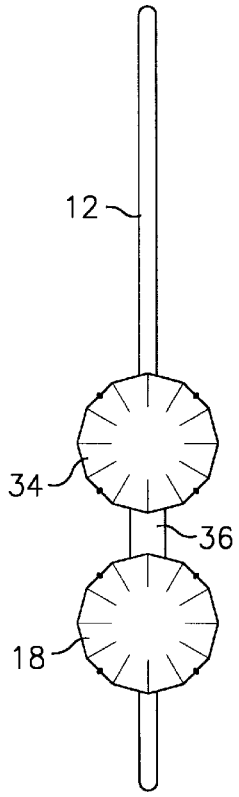
FIG. 8 is a front view of the present invention ornamental assembly of FIG. 5 fitted onto the earring of FIGS. 1 and 2, as shown in FIG. 7.
Figure 7:
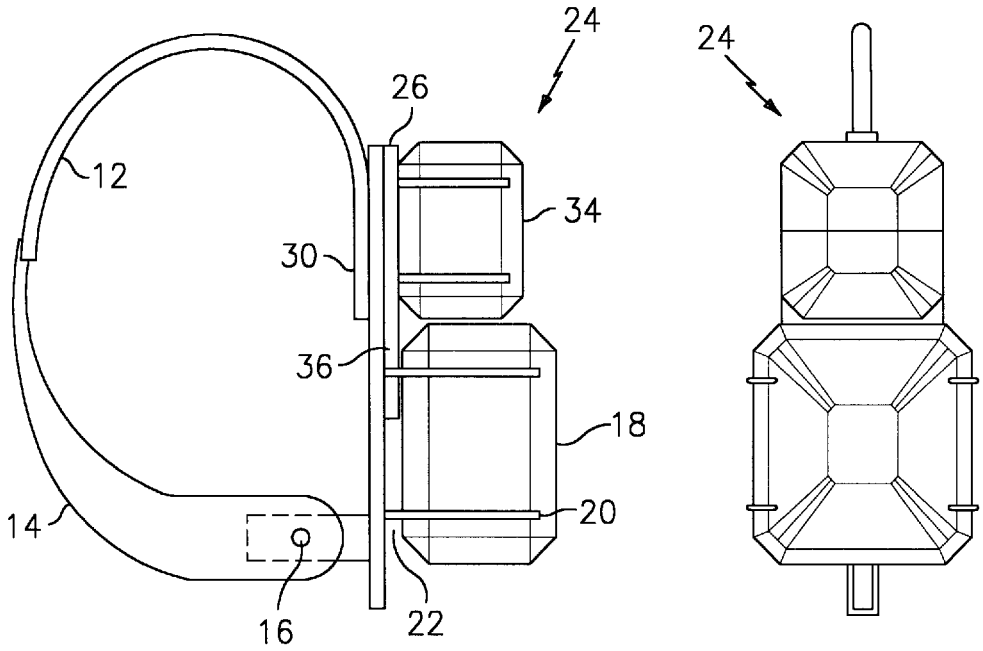
FIG. 7 is a side view of the present invention ornamental assembly of FIG. 5 fitted onto the earring of FIGS. 1 and 2.
Figure 9A:
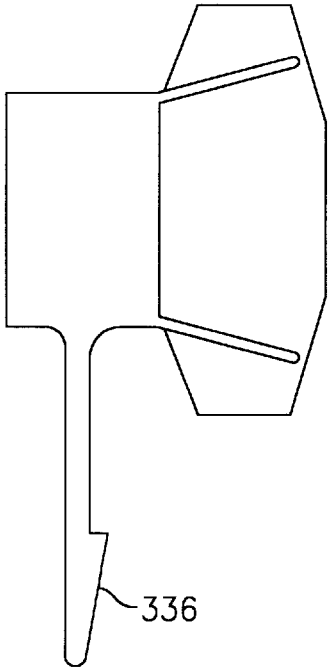
FIG. 9A is a side view of a second embodiment of the present invention supplemental ornamental assembly.
Figure 9B:
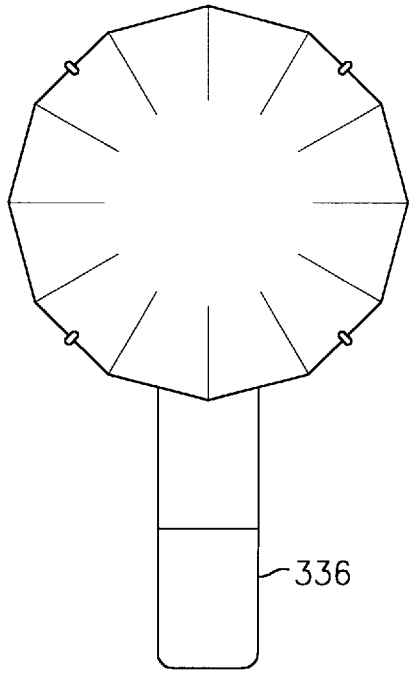
FIG. 9B is a front view the present invention supplemental ornamental assembly of FIG. 9A.
Figure 10A:
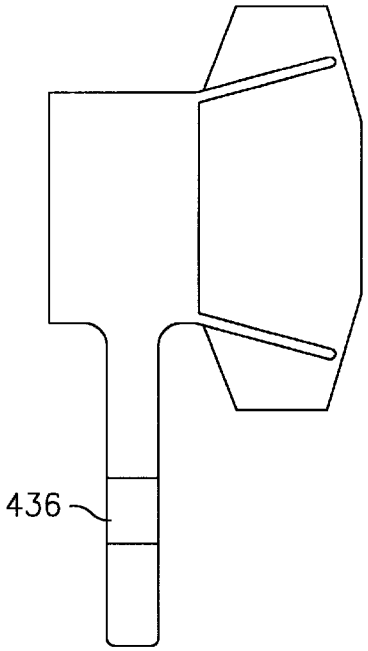
FIG. 10A is a side view of a third embodiment of the present invention supplemental ornamental assembly.
Figure 10B:
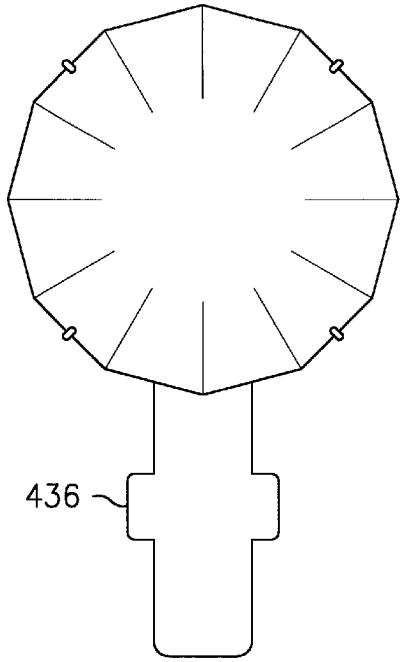
FIG. 10B is a front view the present invention supplemental ornamental assembly of FIG. 10A.

The hole (30) in the body is threaded over the wire (12) of the earring (10) so that the stem (36) will extend down into the gap (22) and position the supplemental gemstone (34) above the original gemstone (18), as shown in FIGS. 7 and 8. Once the stem (36) is received in the gap (22), the supplemental assembly (24) will be prevented from rotating around the wire (12). If desired, the stem (36) can be constructed as a wedge (336), as shown in FIGS. 9A and 9B, to enable a friction-fit to more securely hold the supplemental assembly (24) and prevent axial displacement along the wire (12) relative to setting (20). The stem (36) may also be configured with a cross-piece (436), as shown in FIGS. 10A and 10B, to prevent the supplemental assembly (24) from resting too close to the original gemstone (18) and setting (20). The cross-piece (436) is configured to be wider than the gap (22) so that it will contact the setting (20) to limit further entry into the gap (22). It is recognized that variations of geometric configurations will achieve the results of preventing rotation, preventing axial withdrawal and limiting penetration. The preferred embodiments disclosed here are examples.

An alternative embodiment is shown in FIG. 11, comprising a unitary body (526) having two rings (528, 530) attached thereto for receiving the wire (12) therethrough. The setting (32) is attached to the body (526) and holds a gemstone (34).

Another alternative embodiment is shown in FIG. 12, comprising a unitary body (626) having a hole (628) for receiving the wire (12) therethrough. The body (626) also has a stem-receiving opening (627) for receiving the stem of another supplemental assembly threaded over the wire (12) and positioned on top of it. This embodiment enable successive supplemental assemblies to be stacked on top of one another on the same earring.

The preferred method of making the present invention begins with the step of selecting a Eurowire style earring having a gap (22) or similar means adapted to receive a stem (36). The next step is to select an ornamental structure or gemstone with setting for use in a supplemental assembly. Then, the gemstone setting, such as the setting (32) of FIG. 5, or structure is joined to a body such as the body (26) of FIG. 5 by means of welding or soldering. The body (26), made by conventional casting, molding or other known means, is provided with a hole (30) for receiving an earring wire (12) therethrough. The body is also provided with a downwardly extending stem (36). Alternative embodiments of the body, such as the bodies (526, 626) in FIGS. 11 and 12, can be made to have either rings (528, 530) or a hole (628) for receiving a wire (12). The assembly, having a stone or structure finally mounted thereon, is threaded over the wire (12) by passing the wire through the hole (30, 628) or rings (528, 530) so that the stem (36) is received by a gap (22) between an original setting (20) and the wire (12). The stem (36) prevents rotation of the supplemental assembly relative to the wire (12) and, optionally, is provided with wedges, notches or the like to prevent axial displacement along the wire. The earrings are then worn in the usual manner.

The body (26) and stem (36) can be made of any known or suitable jewelry materials such as, for example, gold, platinum or silver.

While the preferred embodiments of the present invention have been herein described, it is realized that reasonable variation and modification of the embodiments disclosed herein will not depart from the scope of the claimed invention.

What is claimed is:

1. A convertible earring comprising a wire having a first end and a second end;

attaching means on said first end adapted to selectively attach said first end and said second end so that said wire forms a closed loop;

a first ornamental structure fixedly attached to said wire adjacent to said first end and residing in a first vertical position with respect to said closed loop;

a gap formed between said first ornamental structure and said wire;

a second ornamental structure residing between said first ornamental structure and said second end of said wire, and at a second vertical position which is above said first vertical position with respect to said closed loop;

a hole extending through said second ornamental structure and received over said wire; and a stem fixed to and extending downwardly from said second ornamental structure and along said wire in a direction towards said first end of said wire; and removably received in said gap.

2. An earring according to claim 1, wherein said attaching means comprise a hinged clasp jaw adapted to pivot about a point on said first end and being adapted to selectively engage and disengage said second end.

3. An earring according to claim 1, wherein said attaching means comprise a curved end of said wire forming a hook and being adapted to selectively engage and disengage said second end, whereby upon engagement said wire forms a closed loop and is held in spring tension.

4. An earring according to claim 1, wherein said first ornamental structure includes a gemstone held by a setting attached to said wire.

5. An earring according to claim 4, wherein said gap is formed between said gemstone and said wire.

6. An earring according to claim 4, wherein said second ornamental structure comprises at least one ring, whereby said hole is formed through the center of said at least one ring.

* * * * *